United States Patent [19]

Brych

[11] Patent Number: 4,476,633

[45] Date of Patent: Oct. 16, 1984

[54] PLIERS FOR PUNCHING CARDS OR TICKETS

[76] Inventor: Heinz Brych, Caspar Olevianstrasse, 5500 Triert, Fed. Rep. of Germany

[21] Appl. No.: 335,857

[22] Filed: Dec. 30, 1981

[51] Int. Cl.[3] ..... B26F 1/36

[52] U.S. Cl. ..... 30/363; 30/368

[58] Field of Search ..... 30/363, 364, 368, 366, 30/358, 360

[56] References Cited

U.S. PATENT DOCUMENTS

| | | | |
|---|---|---|---|
| 600,587 | 3/1898 | Low | 30/363 |
| 661,896 | 11/1900 | Shands | 30/364 |
| 1,056,546 | 3/1913 | Hummel | 30/363 |
| 1,450,795 | 4/1923 | Dohe | 30/363 |
| 1,476,272 | 12/1923 | Swanson | 30/363 X |
| 1,827,180 | 10/1931 | Williams | 30/363 |
| 2,307,617 | 1/1943 | Braun | 30/363 |
| 2,404,985 | 7/1946 | Rembold | 30/363 |
| 2,738,009 | 3/1956 | Jones | 30/363 |

*Primary Examiner*—Jimmy C. Peters

[57] ABSTRACT

A pair of pliers is provided for perforating small cards, which pliers have two double-arm levers which can be pivoted about a geometrical transverse axis and whose end zones, which serve for perforating, each have a plane, which planes are parallel to the transverse axis and which, in the closed state of the pliers, are approximately parallel to each other. Vertically positioned in one plane is at least one punching pin, to which there corresponds in the opposite end zone a punched hole which is vertical to the plane of the latter. There are provided two positioning pins in one end zone vertically to the plane thereof, which pins are, measured in one of the two main planes, at a specific center distance from the transverse axis. In one end zone, there is provided a first coding box and in the other end zone, there is provided a second coding box, which boxes contain the punching pin and the punch hole respectively, the coding box being sufficiently smaller in dimension, with respect to symbol identification, in the direction that is parallel to the positioning pins than the positioning pin.

13 Claims, 8 Drawing Figures

PLIERS FOR PUNCHING CARDS OR TICKETS

The invention relates to a pair of pliers for perforating small cards, which pliers have two double-arm levers which can be pivoted about a geometrical transverse axis and whose end zones, which serve for perforating, each have a plane, which planes are parallel to the transverse axis and which, in the closed state of the pliers, are approximately parallel to each other, there being vertically positioned in one plane at least one punching pin, to which there corresponds in the opposite end zone a punched hole which is vertical to the plane of the latter.

BACKGROUND OF THE INVENTION

In the restaurant business, correct accounting is a big problem. On the one hand, a wide variety of prices is involved. On the other hand, different things are ordered at widely different times. Furthermore, the correct amount has to be added up for the correct person. In most cases, payment is not made in the exact amount that corresponds to the bill but payment is made in a larger amount, and this then results in the return of money.

Frequently, the establishments have to work with staff who are not trained at all and come from different origins. In isolated cases, there is also staff who line their own pockets. In dealings close to frontiers with two currencies, it is difficult to distinguish between the currencies. More especially the coins of different currencies are sometimes very similar in appearance. For the customer, it is a nuisance having to get out his purse frequently. Often, the illumination is also unfavourable for writing and reading, for example in discotheques. Many customers get angry because they have to wait too long for the paying process to take place. Even if everything has taken place properly, the staff and those who are in charge of the accounting sit together until the early hours of the morning in order to do the accounting. The total turnover of the day and the individual turnover of each waiter or waitress is not known long after the premises have been shut. Also, there frequently arise difficulties with the tax collector who is prone to suspect manipulations in these establishments, so that the position vis-a-vis this authority is also difficult.

OBJECT AND STATEMENT OF THE INVENTION

It is the object of the invention to indicate a pair of pliers which are suitable for a system, the small cards of which system are claimed in a parallel application, these pliers making possible (together with the small cards) an accounting that is so simple that life is made very considerably easier for both the customers and the serving staff and the supervisors.

According to the invention there is provided a pair of pliers for perforating small cards, which pliers have two double-arm levers which can be pivoted about a geometrical transverse axis and whose end zones, which serve for perforating, each have a plane, which planes are parallel to the transverse axia and which, in the closed state of the pliers, are approximately parallel to each other, there being vertically positioned in one plane at least one punching pin, to which there corresponds in the opposite end zone a punched hole which is vertical to the plane of the latter, characterised by the following features: there are provided two positioning pins in one end zone vertically to the plane thereof, which pins are, measured in one of the two main planes, at a specific centre distance from the transverse axis; in one end zone, there is provided a first coding box and in the other end zone, there is provided a second coding box, which boxes contain the punching pin and the punch hole respectively, the coding box being sufficiently smaller in dimension, with respect to symbol identification, in the direction that is parallel to the positioning pins, than the positioning pin.

The positioning pins forcibly bring about an accurate position of the small card and thus of the coding box in the small card. One can punch the holes in the small card for the positioning pins from the outset during the production of the small card, and thus one is in control of the accuracy, in other words one does not have to rely on the serving person's accuracy.

Nevertheless, it is certain that the positioning pins (and the holes in the small card corresponding thereto) do not interfere with the reading of the perforations in the coding box of the small card. Nor is any special effort required to adjust the small card more accurately on the positioning pins because, as the pliers are closed, the punching pin presses the small card against the opposite positioning box prior to punching.

Advantageously, the invention includes the following additional features: the positioning pins are provided in one of the planes that is parallel to the transverse axis. This feature ensures that the positioning pins can be provided at greater intervals, this allowing the small cards to be accurately angularly positioned, too.

The positioning pins are provided—as viewed from the transverse axis—on the other side of the coding boxes. This feature ensures that, with the small card inserted, the positioning pins emerge at the top of the box to be punched, which is psychologically more favourable. Furthermore, the positioning pins then are more likely to move on a path that approximates a straight line, whereby the construction is simplified. The positioning pins and the punching pins are of course elements which are rectilinear and not, for example, curved.

The positioning pins have a larger contour than the punching pins. This feature ensures that the danger of the holes for the positioning pins in the small cards being torn is reduced. Furthermore, it is then impossible to introduce the positioning pins where a punching pin has previously punched.

The positioning pins are provided in that end zone which has the punched holes. This feature allows, on the one hand, the positioning pins to be kept shorter than would be possible if they were provided in the other end zone. On the other hand, one obtains a correct position of the small card that is simpler workwise.

The positioning pin holes in the other end zone correspond to the positioning pins. Due to this feature, the positioning pins are given guidance shortly before the pliers are closed and the surface by which the small card is later held grows by the surface between the positioning pin holes. In this zone, there is thus never formed a crease in the small card.

The coding boxes comprise at least five punching pin positions which are arranged in a grid. This feature allows the grid to be made sufficiently small so that there is space for a sufficient number of accounting operations on a small card and the punched holes are later nevertheless easily readable. Furthermore, despite these very simple pliers, it is then possible for up to 32 serving persons to work in the system.

The coding boxes comprise six punching pin positions arranged in a grid. Due to this feature, one obtains advantages which are very similar to those immediately above, but one has so many possibilities of combination that even if, for example, 30 serving persons are involved, there is left for each type of punching one hole for the parity check.

By using circular punching pins, it is possible both to produce these cheaply and to produce the punched holes by means of simple bores.

The grid comprises two lines and three columns, the column length is relevant for the spacing concerning symbol identification. Due to this feature, one obtains a clearly set out space-saving punching pattern, which is conducive to the rectangular shape of a small card and which, through the bores, weakens the other end zone of the pliers evenly, on the one hand, and not excessively, on the other hand.

The coding box is very close to the positioning pins. Due to this feature, one obtains a high data density and furthermore the accuracy of the punched holes in the small card becomes the better the closer the coding box is to the positioning pins.

The coding boxes and the zone for the positioning pins each form a plane which extends parallel to the transverse axis. This feature ensures that the flat card is held flatly and that, as the pliers are closed, there is no tendency which might cause the card to slip.

In the end zone that is associated with the punching pin, a leaf spring is provided having an external end zone which has a hole approximately in coincidence with the punch hole and another end zone which is rigidly fastened to an associated double-arm lever and the leaf spring has a position in which the hole in the leaf spring is at distance from the end of the punching pin when the pliers are open, and the leaf spring is considerably thinner than the punching pin is high. These features ensure that the leaf spring presses the small card down on one end zone and that the punching pins are given a preliminary guidance and that the small card can be moved from the punching pins parallel to these latter (so that the punched holes just produced are not torn) and that nevertheless one can make the punching pins short and thus stable to punching.

A maximum of two punching pins is provided, preferably one punching pin having a circumferential configuration which contains invalidating information that is related to a person. This feature ensures that it is also possible to work reliably in an environment in which the light is particularly poor, so that it cannot in any event happen that the serving person, for example because of the already existing positioning holes for the positioning pins, confuses these with the last punching. One then has to associate with each serving person a specific punching pin circumferential configuration such as, for example, a dash, cross, star, quarter of the moon, square, etc.

DESCRIPTION OF THE DRAWINGS

The invention will now be described with the aid of a preferred exemplified embodiment. In the drawings.

DETAILED DESCRIPTION

Figure 1:
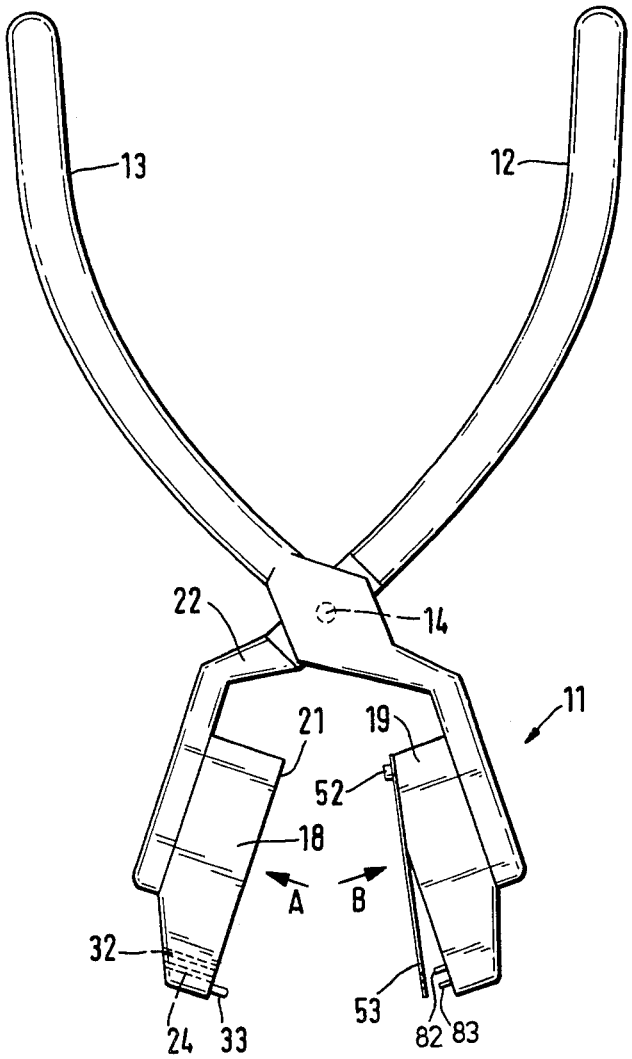
FIG. 1 shows a top view of a pair of pliers.

A pair of pliers 11 has a first double-arm lever 12 and a second double-arm lever 13. They are connected in a central zone by a pivot so as to be pivotable relative to each other in the usual way, so that the levers 12, 13 can pivot about a geometrical transverse axis 14 which in FIG. 1 is vertical to the drawing plane. Massive shoes 18 and 19, which are made of metal and have a shape that is similar to a brake shoe, are screwed with the aid of screws 16 to the ends of the levers 12 and 13 respectively.

The shoe 18 has on its inside a plane 21 which is not only parallel to the transverse axis 14 but passes through this axis, which is possible because of the crank 22. Inside a coding box 23, which is shown in dash-dotted lines, there are provided through bores 24, 26, 28, 29, 31, 32 which form punch holes and are circular-cylindrical. The through bores 24, 26, 28 are located parallel to the transverse axis 14, and the through bores 29, 31, 32 are also parallel to the latter and to these bores, so that there is formed a 2×3 arrangement which has its larger extension parallel to the transverse axis 14.

Figure 2:
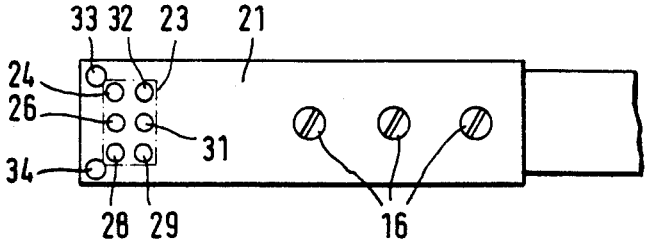
FIG. 2 shows a view thereof in the direction of the arrow A in FIG. 1, on a scale of 2:1.
Figure 3:
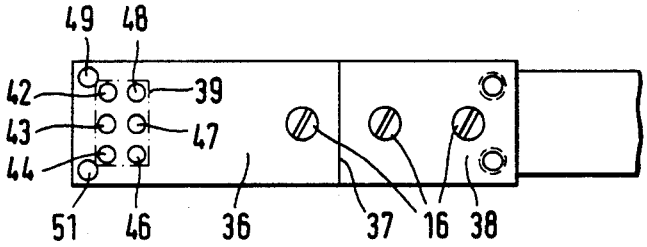
FIG. 3 shows a view according to the arrow B in FIG. 1, on a scale of 2:1, but without the leaf spring.
Figure 4:
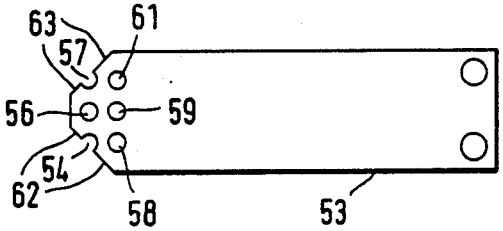
FIG. 4 shows a view, according to the arrow B in FIG. 1, of the leaf spring by itself on a scale of 2:1.

The through bores thus formed always are at the same distance from their neighbour. As shown in FIG. 2, there are provided to the left of the coding box 23, closely adjacent thereto, two vertically projecting positioning pins 33, 34 which sit in the left-hand corner zones of the plane 21. Their diameter is about 1.47 mm. The diameter of the through bores 24 etc. is about 1.3 mm.

Figure 5:
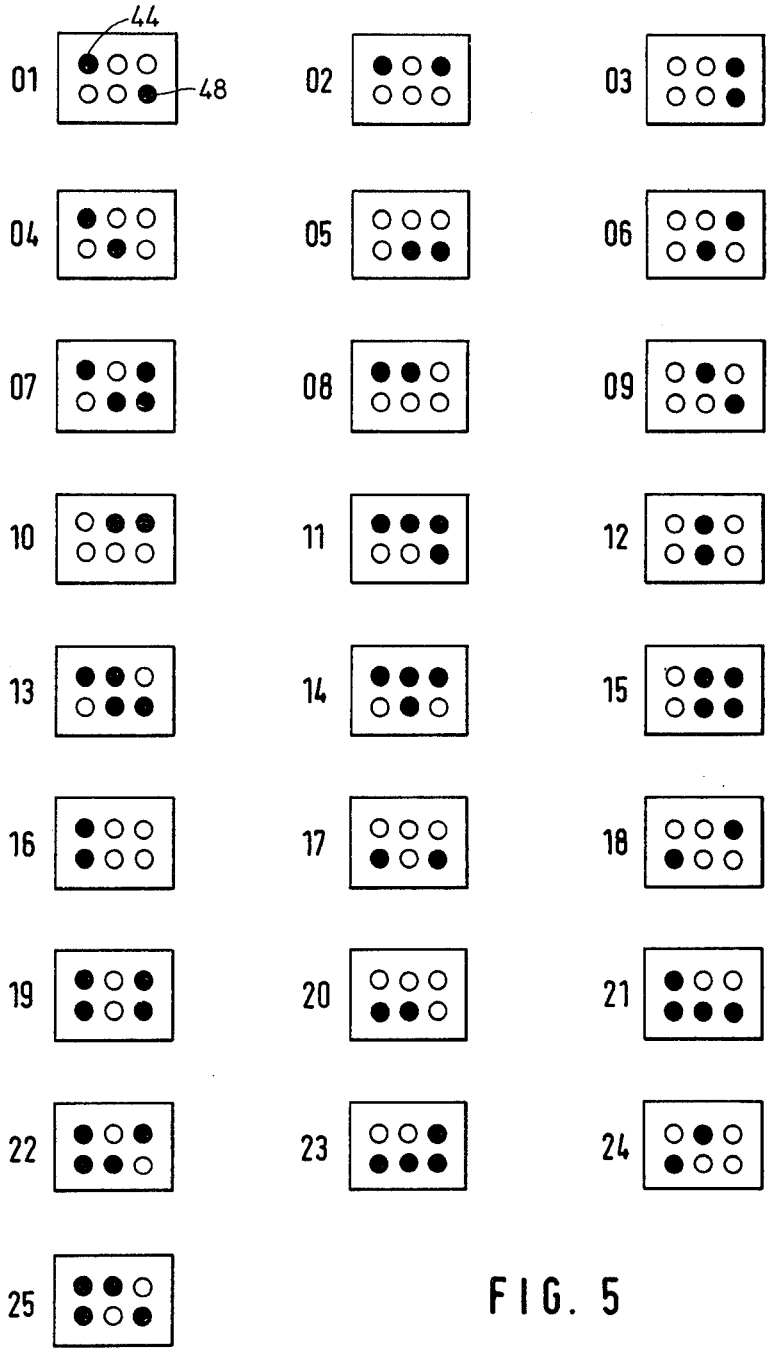
FIG. 5 shows a number of possible arrangements of the punched holes but also of the holes which have to be punched into a small card in the event of 25 serving persons being involved.

The other shoe 19 has a plane 36 which also passes through the transverse axis 14 and which, after a bend 37, merges in a plane 38 which is at an acute angle of approximately 15° thereto. On the left-hand side, the plane 36 has again a coding box 39 that corresponds to the coding box 23, which boxes lie one upon the other in coincidence when the pliers 11 are closed. In accordance with the arrangement of the through bores 24 etc., there are provided in the coding box 39 punching pin positions 42, 43, 44, 46, 47, 48. These are "positions" because, as shown in FIG. 5, there is no need to provide all of the punching pins. By contrast, one can provide the through bores 24 etc. for reasons of rationalisation, since these are inactive without the punching pins.

Corresponding to the positioning pins 33, 34, there are provided to the left of the coding box 39 through bores 51, 49, into which the positioning pins 33, 34 begin to plunge when the pliers 11 have not yet been completely closed.

In the plane 38, there is fastened by means of screws 52 a thin flat leaf spring 53 which is exactly as wide as the shoe 19 is high. In the opened state, and when the leaf spring 53 is untensioned, its external end projects considerably from any existing punching pins. When the pliers 11 are closed, the plane 21, with its external zone, presses the leaf spring 53 against the plane 36. During this process, the existing punching pins traverse the through bores 54, 56, 57, 58, 59, 61 which are arranged in the same way as the through bores 24 etc. and lie above these in coincidence but whose diameter is considerably larger than the outside diameter of any existing punching pins. Furthermore, the through bores 54, 57 are cut by chamfers 62, 63. Evidently, no through bores are provided for the positioning pins 33, 34.

FIG. 5 shows which punching pin positions are occupied if 25 serving persons are involved. It is obvious that the punching pin positions are already prepared in so far as the bores for the punching pins may already be provided. Punching pins are then inserted into these holes, which are also preferably through bores, at specific points only.

For the serving person 01, the punching pin position 48 has a punching pin 82, which signifies "01". The punching pin position 44 is also occupied by pin 83, so as to allow a parity check to be made.

For the serving person 02, one has a pair of pliers whose punching pin position 42 is occupied, which signifies 2. Furthermore, the punching pin position 44 is occupied, which again serves for the parity check. The serving person 03 has a pair of pliers whose punching pin position 48 is occupied, which signifies "1" previously. The punching pin position 42 is "2", as previously, which comes to 3 in all. A parity check is then obtained in any event because of the two holes which later exist in the small card.

The serving person 04 has a pair of pliers whose punching pin position 47 is occupied, which signifies "4", and the occupied punching pin position 44 again serves for the parity check.

The serving person 05 has a pair of pliers whose punching pin positions 48 (=1) and 47 (=4) are occupied, which makes a total of 5. In the case of the serving person 06, the pair of pliers has the positions 42 and 47 occupied, which comes to 2+4=6 and does not necessitate any parity check.

In the case of the serving person 07, the punching pin positions 42, 48 and 47 are occupied, which comes to 2+1+4=7, and the punching pin position 44 is again occupied for parity check reasons. The serving person 08 has a pair of pliers whose punching pin positions 43 and 44 are occupied, the punching pin position 43 signifying "8" and 44 being again relevant for the parity check.

In the case of the serving person 09, the punching pin positions 48 (=1) and 43 (=8) are occupied, which comes to a total of "9". In the case of the serving person 10, the punching pin positions 42, 43 are occupied, which comes to 8+2=10; etc.

Even if 25 serving persons are involved, there is provided a maximum of four punching pins, which hardly weakens the small cards. The arrangement is such that if the small cards consist, for example, of the material Syntape made by the American Tobacco company, the cards may be crumpled up and nevertheless remain processable.

Figure 6:
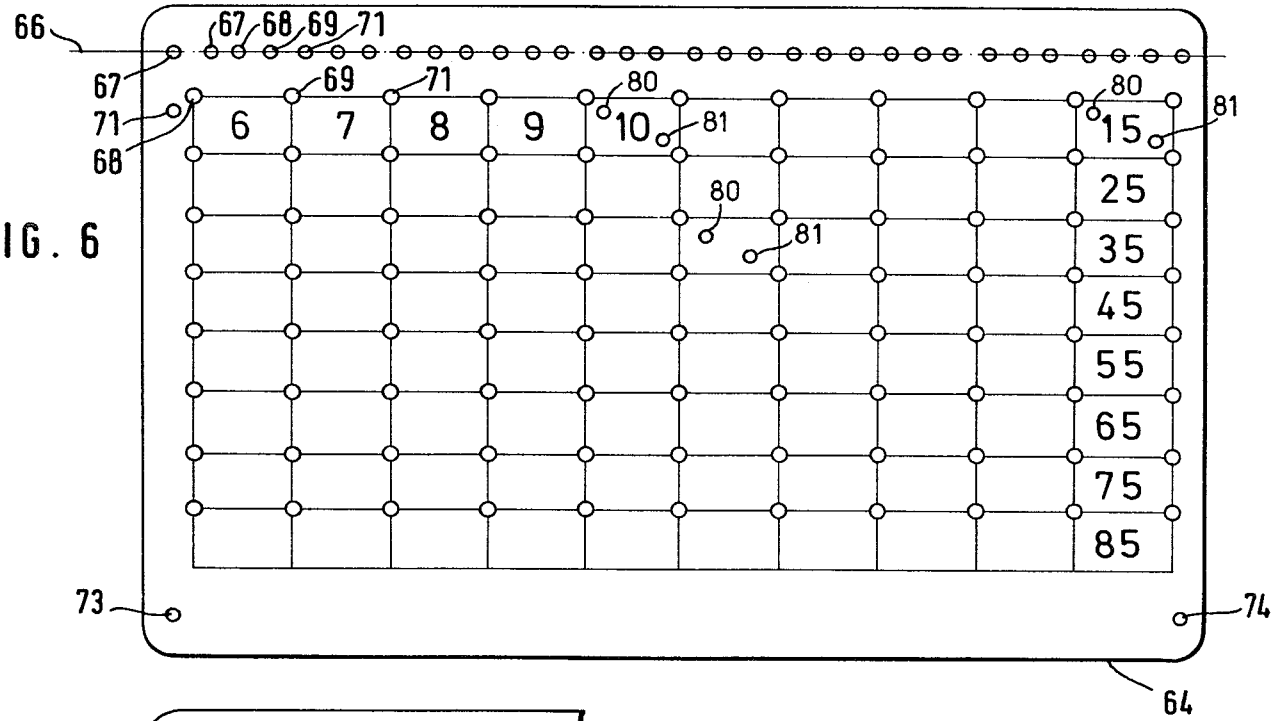
FIG. 6 shows a top view of an accounting card on a scale of 2:1.

Referring to FIG. 6, a small card 64 is 87 mm long and 55 mm high and consists of the mentioned material Syntape. Its size is thus approximately that of a cheque card. The upper edge and the lower edge are parallel to each other, and so are the right-hand and left-hand edges, and these groups are vertical to one another. At a centre distance of 3.75 mm from the upper edge, there are provided the clocking holes, all of which lie in a straight line 66 which is parallel to the upper edge. Their diameter is 1.3 mm. The top left-hand clocking hole 67 is at a distance of 2.5 mm from the left-hand edge. There follows a clocking hole 67 at a distance of 3 mm. The distance between the following clocking holes 68, 69 is 2.5 mm. There follows again a clocking hole 71 at a distance of 3 mm. Altogether, there are provided ten of such groups of three holes, which have the 2.5 mm spacing between the holes of one group and the 3 mm spacing between the groups.

Beneath the 3 mm spacing and centrally thereto, there are provided eight positioning perforations 68 which are at equal centre spacings of 5 mm from one another. Their diameter is 1.5 mm. To the right of the positioning hole 68, there is provided a positioning hole 69 at a distance of 8 mm. Therebeneath, there is printed a box in which the number "6" is shown. To the right of the positioning hole 69, there is provided a positioning hole 71 at a distance of 8 mm beneath the 3 mm spacing, and beneath this hole there are seven more positioning holes of identical configuration. In this way, there is formed a grid for positioning holes, as shown in FIG. 6, into which holes the positioning pins 33, 34 can be introduced. Since the first box has the number "6", the number "85" has been printed into the last box on the bottom right-hand side.

FIG. 6 shows an accounting card because this card starts with 6. The customer has thus already had a deduction of five units (e.g. DM) for admission. The respective serving person introduces into the boxes 6, 7, 8 etc. the punchings shown in FIG. 5. If the customer now uses four units, then the serving person punches one of the codes of FIG. 5. If the visitor thereafter uses up six units, then the box 15 is punched, etc.

Each serving person has a pair of pliers whose punching pins are arranged at specific points to provide a code that identifies that particular serving person. In FIG. 5, the arrangement shown by the pin positions 44, 48, in the coding box in the upper left hand corner represents serving person 01. Each time serving person 01 punches the customer's accounting card (the customer's check) to reflect the increased total of the customer's charges, the holes are punched in the arrangement shown in coding box 01 in FIG. 5. As shown in FIG. 6, for example, the customer's card is punched with the holes 80, 81 at positions 10, 15 and 31, corresponding to pin positions 44, 48 shown in FIG. 5. The customer has incurred total charges corresponding first to 10 units, then 15 units, then 31 units. In this way, each accounting card not only shows the total of the customer's charges, but the particular serving person that served that customer. This is important for accounting purposes.

Figure 7:
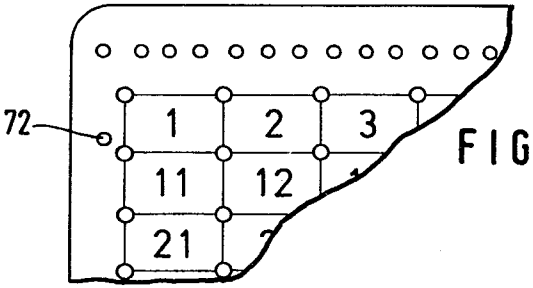
FIG. 7 shows a top view of the left-hand upper zone of an additional card on a scale of 2:1.

Beneath the clocking hole 67, close to the positioning perforation 68, there has been punched at the outset an identification hole 71 which tells a human or mechanical reader that this is an accounting card. In the case of FIG. 7, this identification hole 72, whose diameter is the same as that of the clocking holes and the punch holes, is provided close to a positioning hole which is provided at a somewhat lower point. The human or mechanical reader learns therefrom that this is an additional card, whose top left-hand box starts with 1 and is numbered consecutively 2, 3 etc. Such a card is used if the 85 units of the accounting card are not sufficient.

Both the accounting card shown in FIG. 6 and the additional card shown in FIG. 7 have at the bottom left-hand and right-hand sides holes 73, 74 which are located vertically beneath the first and last clocking holes respectively and tell a mechanical reader that reading either starts or is finished.

Figure 8:
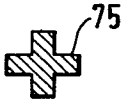
FIG. 8 shows the cross section of a punching pin having a specific circumferential configuration.

It is possible to effect other punchings than those shown in FIG. 5. FIG. 8 shows the cross section of a cruciform punching pin. Here, the association with the serving person resides in the shape of the punching pin. Of course, the punched hole is then formed accordingly.

I claim:

1. A pair of pliers for perforating small cards, which pliers have:

two double-arm levers pivotable about a geometrical transverse axis and end zones which serve for perforating, each zone having a plane, which planes are parallel to said transverse axis and which, in the closed state of the pliers, are approximately parallel to each other, at least one punching pin vertically positioned in one plane, a punch hole corresponding to said punching pin, in the opposite end zone, which is vertical to the plane thereof; and the improvement comprising:

two positioning pins in one end zone oriented vertically to the plane thereof, which pins, measured in one of said two planes, are at a specific center distance from said transverse axis, a first coding box provided in one end zone, a second coding box provided in the other end zone, said coding boxes contain said punching pin and said punch hole respectively, said coding boxes being sufficiently smaller, with respect to symbol identification, in the direction parallel to said positioning pins, than the space between said positioning pins.

2. A pair of pliers as claimed in claim 1, wherein said positioning pins are provided in one of said planes that is parallel to said transverse axis.

3. A pair of pliers as claimed in one of claims 1 or 2, wherein said positioning pins are provided—as viewed from said transverse axis—on the other side of said coding boxes.

4. A pair of pliers as claimed in claim 1, wherein said positioning pins have a larger contour than said punching pins.

5. A pair of pliers as claimed in claim 1, wherein said positioning pins are provided in that end zone which has said punch holes.

6. A pair of pliers as claimed in claim 1, comprising positioning pin holes in the other end zone which correspond to said positioning pins.

7. A pair of pliers as claimed in claim 1, wherein said coding boxes comprise at least five punching pin positions which are arranged in a grid.

8. A pair of pliers as claimed in claim 1, wherein said coding boxes comprise six punching pin positions arranged in a grid.

9. A pair of pliers as claimed in claim 8, wherein said grid comprises two lines and three columns, the column length being relevant to the spacing concerning symbol identification.

10. A pair of pliers as claimed in claim 1, wherein said coding box is very close to said positioning pins.

11. A pair of pliers as claimed in claim 1, wherein said coding boxes and the zone for said positioning pins each form a plane which extends parallel to said transverse axis.

12. A pair of pliers as claimed in claim 1, wherein in the end zone that is associated with said punching pin a leaf spring is provided having an external end zone which has a hole approximately in coincidence with said punch hole and another end zone which is rigidly fastened to an associated double-arm lever, said leaf spring has a position in which said hole in said leaf spring is at a distance from the end of said punching pin when the pliers are open, and said leaf spring is considerable thinner than said punching pin is high.

13. A pair of pliers as claimed in claim 1, wherein a maximum of two punching pins is provided, preferably one punching pin having a circumferential configuration which contains invalidating information that is related to a person.

* * * * *